US008677527B2

(12) United States Patent
Hartenstine et al.

(10) Patent No.: US 8,677,527 B2
(45) Date of Patent: Mar. 25, 2014

(54) PORTABLE PLAYYARD WITH A STORAGE UNIT

(75) Inventors: Curtis M. Hartenstine, Birdsboro, PA (US); Sharon A. Gillett, Salem, OR (US); Jonathan M. Pacella, Coatesville, PA (US)

(73) Assignee: Wonderland Nurserygoods Company Limited, Central (HK)

( * ) Notice: Subject to any disclaimer, the term of this patent is extended or adjusted under 35 U.S.C. 154(b) by 14 days.

(21) Appl. No.: 13/206,156

(22) Filed: Aug. 9, 2011

(65) Prior Publication Data

US 2012/0037868 A1 Feb. 16, 2012

Related U.S. Application Data

(60) Provisional application No. 61/401,310, filed on Aug. 11, 2010.

(51) Int. Cl.
*A47D 13/06* (2006.01)

(52) U.S. Cl.
USPC ..... 5/93.1; 5/96.1; 5/99.1

(58) Field of Classification Search
USPC ..... 5/98.1, 98.2, 99.1, 93.1
See application file for complete search history.

(56) References Cited

U.S. PATENT DOCUMENTS

| | | | | |
|---|---|---|---|---|
| 6,192,535 | B1 * | 2/2001 | Warner et al. | 5/93.1 |
| 6,385,800 | B1 * | 5/2002 | Chen et al. | 5/99.1 |
| 6,907,627 | B2 * | 6/2005 | Waldman et al. | 5/99.1 |
| 7,418,745 | B2 * | 9/2008 | Paesang et al. | 5/98.1 |
| 7,458,114 | B2 * | 12/2008 | Troutman | 5/93.1 |
| 8,006,326 | B2 * | 8/2011 | Thomas et al. | 5/99.1 |
| 2006/0225204 | A1 * | 10/2006 | Bretschger et al. | 5/93.1 |
| 2012/0266380 | A1 * | 10/2012 | Conrad et al. | 5/93.1 |

* cited by examiner

*Primary Examiner* — Fredrick C Conley
*Assistant Examiner* — Duoni Pan
(74) *Attorney, Agent, or Firm* — Polsinelli PC

(57) ABSTRACT

A portable playyard comprises: a playyard frame having two opposite upper side rails and an upper end rail; a crossing rod bridging the upper side rails; a flexible bottom wall mounted to a bottom side of the playyard frame; a flexible surrounding wall unit mounted to the playyard frame and including two opposite side walls and an end wall; a flexible partitioning wall connected to the playyard frame, trained on the crossing rod and having a vertical wall portion extending downwardly from the crossing rod, the vertical wall portion cooperating with the end wall to define a chamber therebetween; and at least one flexible shelf disposed in the chamber and connected to and cooperating with the partitioning wall to define a storage compartment therebetween.

8 Claims, 7 Drawing Sheets

PORTABLE PLAYYARD WITH A STORAGE UNIT

CROSS-REFERENCE TO RELATED APPLICATIONS

This application claims priority of U.S. Provisional Application No. 61/401,310, filed on Aug. 11, 2010.

BACKGROUND OF THE INVENTION

1. Field of the Invention

The invention relates to a portable playyard with an integrated storage unit, particularly to a portable playyard with an integrated storage unit formed in an interior of a playyard frame.

2. Description of the Related Art

U.S. Pat. No. 6,952,849 discloses a portable playyard that includes a playyard frame and an organizer (i.e., an article storage unit) mounted detachably to an exterior of the playyard frame through a pair of hooks. The organizer includes storage compartments for storing child's necessities or articles, such as diapers, wipe cases, creams and cloths.

Since the organizer is removable from the playyard frame, it may be undesirably left behind or lost during traveling with the playyard. In addition, the storage compartments tend to deform by the weight of the articles stored therein, which can result in inconvenience in accessing into the storage compartments, and the mechanical strength of the hooks is normally not strong enough to support a heavy load and is not suitable to permit the organizer to have a large size storage compartment. Moreover, since the organizer is mounted on an exterior of the playyard, it becomes a protruding obstacle around the playyard.

SUMMARY OF THE INVENTION

Therefore, an object of the present invention is to provide a portable playyard with an integrated storage unit that can overcome the aforesaid drawbacks associated with the prior art.

According to one aspect of this invention, there is provided a portable playyard. The portable playyard comprises: a playyard frame having two opposite upper side rails and an upper end rail interconnecting the upper side rails in end-to-end relationship; a crossing rod bridging the upper side rails and disposed adjacent to the upper end rail; a flexible loop-shaped surrounding wall unit mounted to the playyard frame and defining an inner space, the surrounding wall unit including two opposite side walls connected respectively to the upper side rails and extending downwardly therefrom, and an end wall connected to the upper end rail and extending downwardly therefrom; a flexible partitioning wall connected to the playyard frame, trained on the crossing rod and having a vertical wall portion extending downwardly from the crossing rod into the inner space, the vertical wall portion being secured to the side walls and cooperating with the end wall to define a chamber therebetween; and at least one flexible shelf disposed in the chamber, interconnecting the vertical wall portion and the end wall, and cooperating with the vertical wall portion to form a storage compartment therebetween for storing articles therein.

According to another aspect of this invention, there is provided a portable playyard. The portable playyard comprises: a foldable playyard frame; a loop-shaped flexible surrounding wall unit mounted to the playyard frame and defining an inner space; and a flexible storage unit disposed in the inner space and secured to the surrounding wall unit. The storage unit together with the surrounding wall unit is extended by extension of the playyard frame and is collapsed by folding of the playyard frame.

Preferably, the storage unit defines at least one storage compartment for storing articles therein, and the surrounding wall unit includes at least one side wall that is formed with at least one access opening for access into the storage compartment.

More preferably, the storage unit defines a plurality of storage compartments disposed at different levels for storing articles therein, and the surrounding wall unit includes at least one side wall that is formed with a plurality of access openings for access into the storage compartments, respectively.

According to yet another aspect of this invention, there is provided a portable playyard. The portable playyard comprises: a foldable playyard frame; and a flexible storage unit disposed within the foldable playyard frame and connected to the playyard frame in such a manner that the storage unit is extended to form at least one storage compartment by extension of the playyard frame and is collapsed by folding of the playyard frame.

Preferably, the storage unit is extended to form a plurality of storage compartments that can be accessed at different sides of the playyard frame.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

FIGS. 1 to 4 illustrate the first preferred embodiment of a portable playyard with an integrated flexible storage unit 1 according to this invention for storing child's necessities or articles, such as diapers, wipe cases, creams and cloths.

Figure 1:
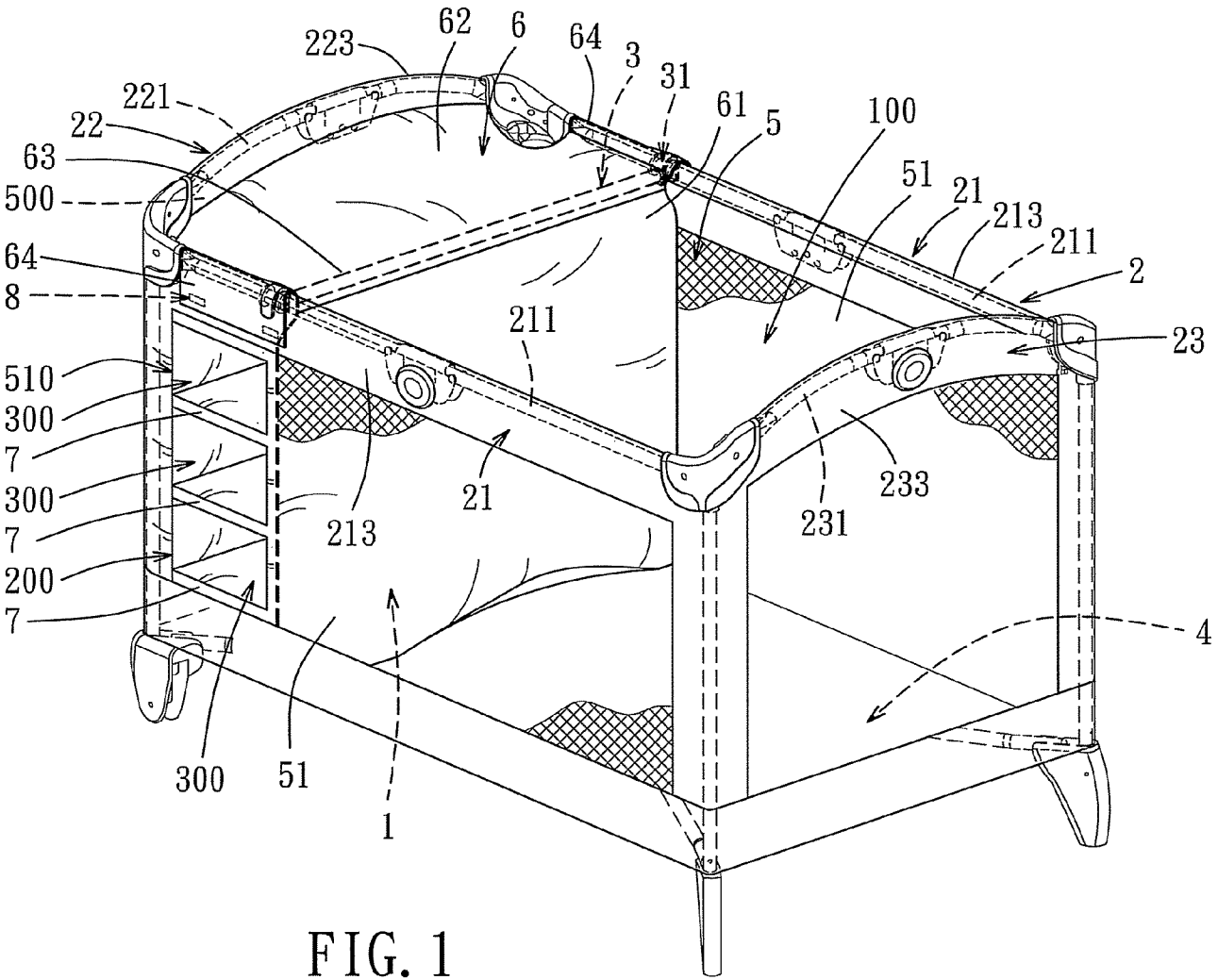
FIG. 1 is a front perspective view of the first preferred embodiment of a portable playyard according to the invention.
Figure 2:
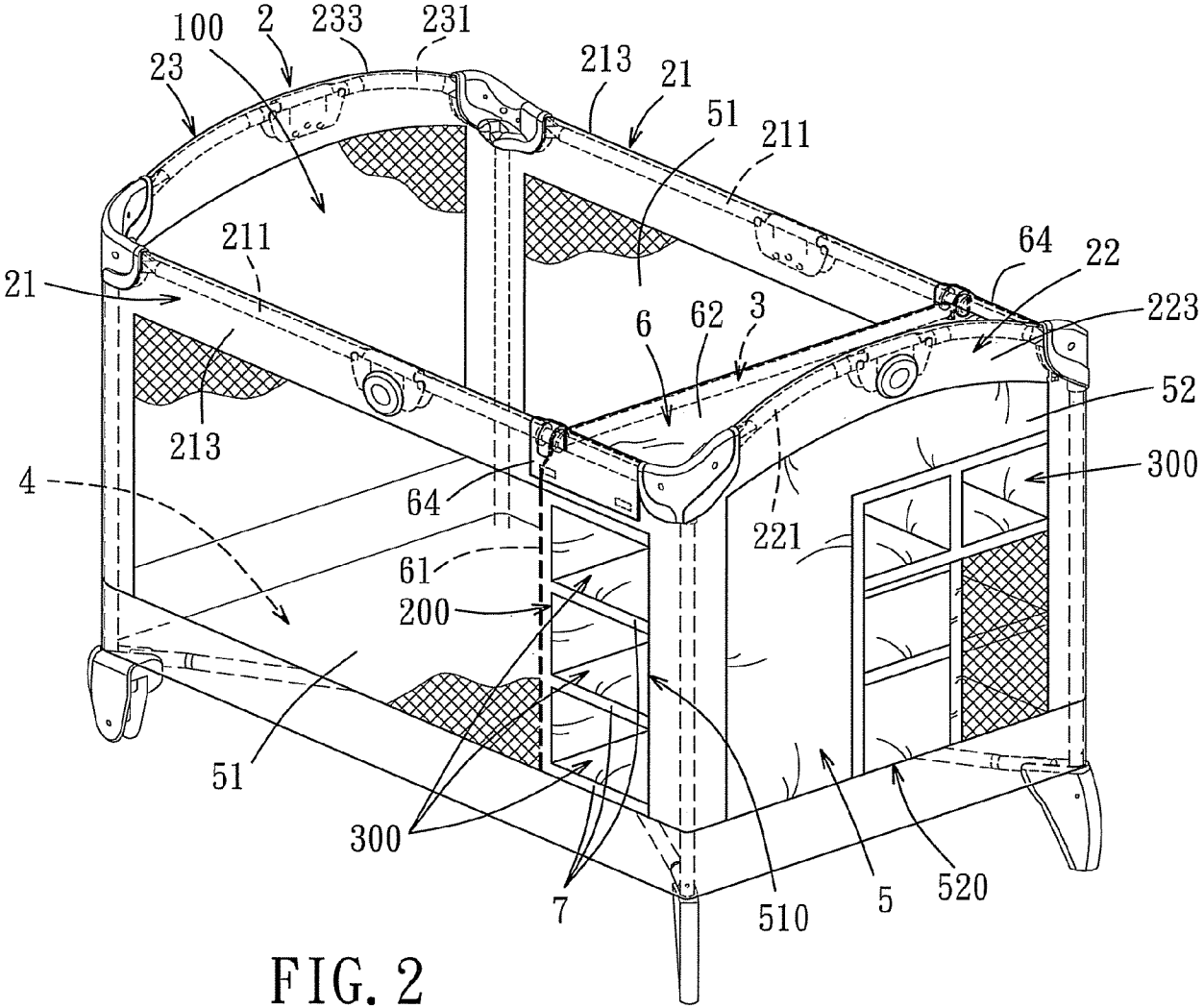
FIG. 2 is a rear perspective view of the first preferred embodiment.
Figure 3:
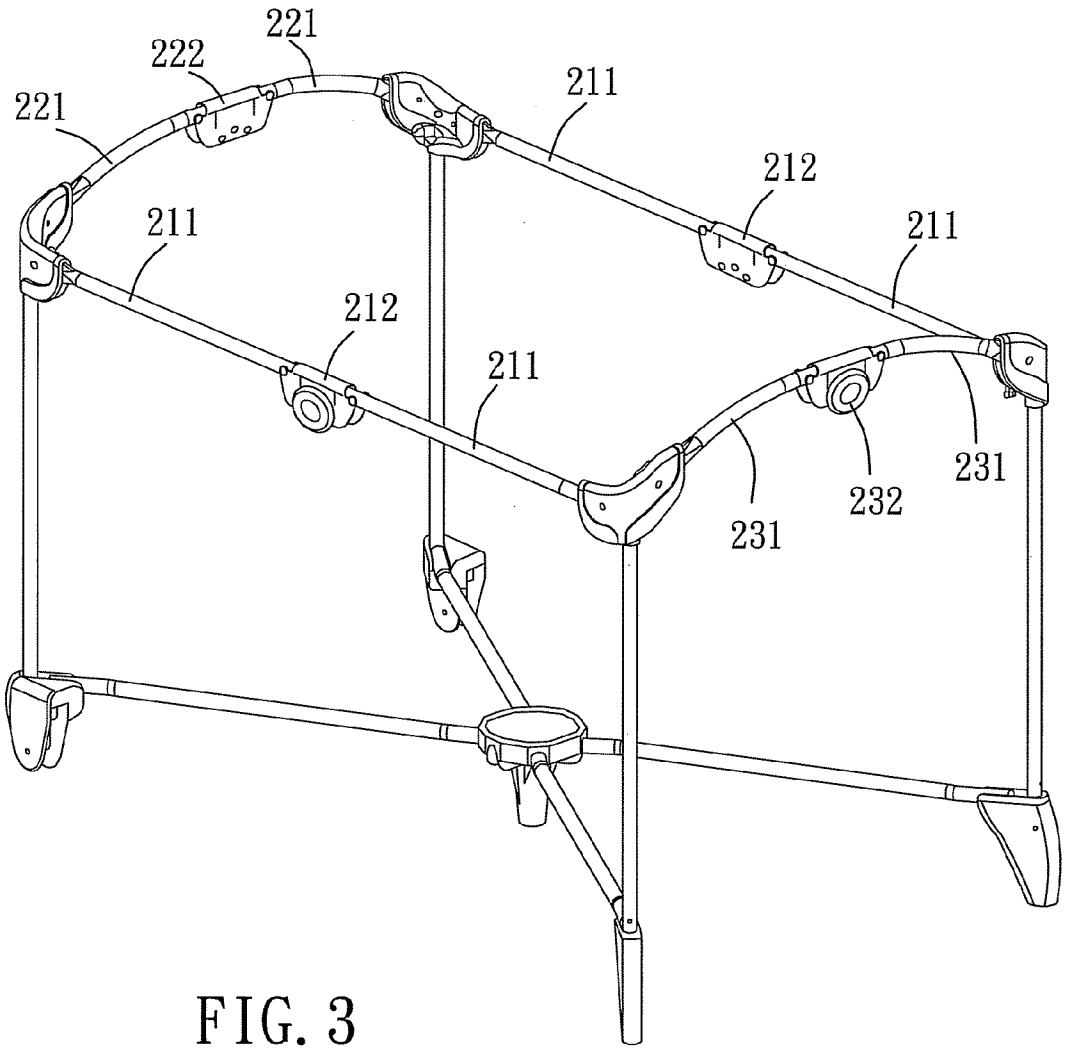
FIG. 3 is a perspective view of a skeleton of a playyard frame of the first preferred embodiment.

The portable playyard includes: a playyard frame 2 having two opposite upper side rails 21 and first and second upper end rails 22, 23 interconnecting the upper side rails 21 in end-to-end relationship; a crossing rod 3 bridging the upper side rails 21 and disposed adjacent to the first upper end rail 22; a flexible bottom wall 4 mounted to a bottom side of the playyard frame 2; a flexible loop-shaped surrounding wall unit 5 mounted to the playyard frame 2 and defining an inner space 100, the surrounding wall unit 5 including two opposite side walls 51 connected respectively to the upper side rails 21 and extending downwardly therefrom, and an end wall 52 connected to the first upper end rail 22 and extending downwardly therefrom; a flexible partitioning wall 6 connected to the playyard frame 2, trained on the crossing rod 3 and having a vertical wall portion 61 extending downwardly from the crossing rod 3 into the inner space 100, the vertical wall portion 61 being secured to the side walls 51 by stitching and cooperating with the end wall 52 to define a chamber 200 therebetween; and three flexible shelves 7 disposed at different levels in the chamber 200, interconnecting the vertical wall portion 61, the end wall 52 and the side walls 51 through stitching, and cooperating with the partitioning wall 6 to form the flexible storage unit 1 that is integrated to the playyard frame 2 by stitching to the surrounding wall unit 5, that is collapsible, and that forms three storage compartments 300 for storing articles (not shown) therein when disposed at an extended state (see FIGS. 1 and 2).

In this preferred embodiment, the playyard frame 2 of the playyard of this invention is foldable. Alternatively, the playyard frame 2 of the playyard of this invention can be non-foldable.

The surrounding wall unit 5, the partitioning wall 6 and the shelves 7 are made from a fabric material. Each of the side walls 51 and the end wall 52 is formed with access openings 510, 520 for access into the storage compartments 300 so that the storage compartments 300 can be accessed at different sides of the playyard frame 2. Since the partitioning wall 6 and the shelves 7 are stitched to each other and are further stitched to the surrounding wall unit 5, the storage unit 1 together with the surrounding wall unit 5 can be collapsed upon folding of the playyard frame 2, and can be extended and stretched to the extended state upon extension of the playyard frame 2.

In this embodiment, each of the upper side rails 21 has two side connecting tubes 211 pivoted to each other through a middle pivot joint 212, and two side tube enclosures 213 of a cloth material enclosing the side connecting tubes 211, respectively. Each of the first and second upper end rails 22, 23 has two end connecting tubes 221, 231 pivoted to each other through an end joint 222, 232, and two end tube enclosures 223, 233 of the cloth material enclosing the end connecting tubes 221, 231. Each of the upper side rails 21 is provided with a pair of annular limiting plates 214 (see FIG. 5) that cooperatively define a clamping groove 215 therebetween.

The upper side rails 21 cooperate with the first upper end rail 22 and the crossing rod 3 to define an upper opening 500 of the playyard frame 2 thereamong. The partitioning wall 6 further has an extension wall portion 62 extending from the vertical wall portion 61 and cooperating with the vertical wall portion 61 to form a generally inverted L-shaped turn 63 therebetween. The inverted L-shaped turn 63 is trained on the crossing rod 3. The extension wall portion 62 has peripheral sides secured to the first upper end rail 22 and the upper side rails 21 by stitching, and covers the upper opening 500.

In this embodiment, the crossing rod 3 is detachably mounted to the upper side rails 21, and has two opposite ends, each of which is provided with an end connector of C-shaped clamp 31 that is fitted into the clamping groove 215 and that is tightly sleeved on a respective one of the upper side rails 21, thereby preventing the crossing rod 3 from sliding on the upper side rails 21.

The partitioning wall 6 further has two opposite wing portions 64, each of which extends from the extension wall portion 62 and covering an upper end of a respective one of the upper side rails 21 and a respective one of the C-shaped clamps 31 so as to prevent undesired detachment of the C-shaped clamps 31 from the playyard frame 2. Each of the wing portions 64 is secured to the side tube enclosure 213 of the respective one of the upper side rails 21 through a loop-and-hook interlocking mechanism 8, such as a Velcro fastener.

Figure 4:
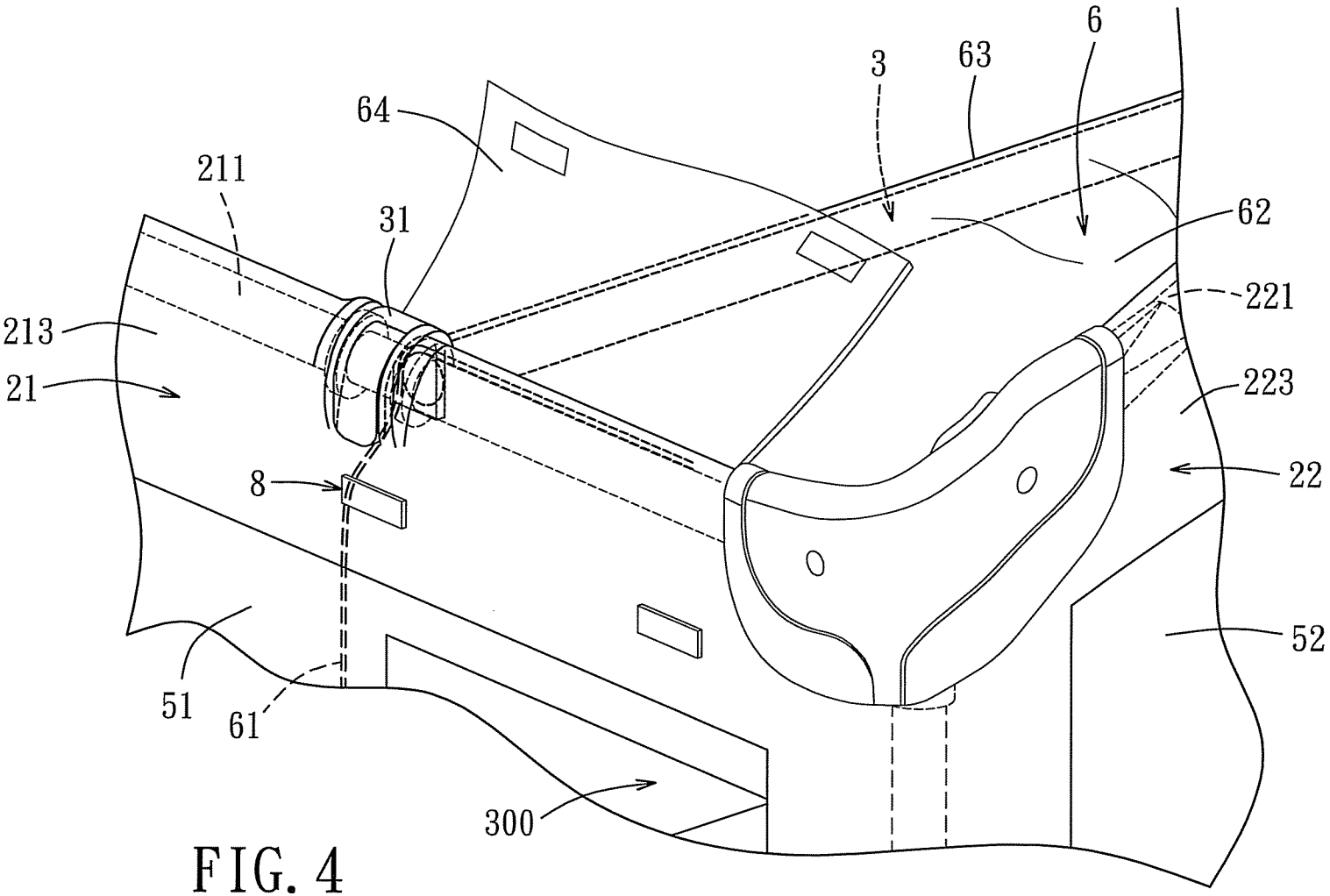
FIGS. 4 to 6 are fragmentary perspective views to illustrate how a crossing rod is detached from the playyard frame of the first preferred embodiment.
Figure 5:
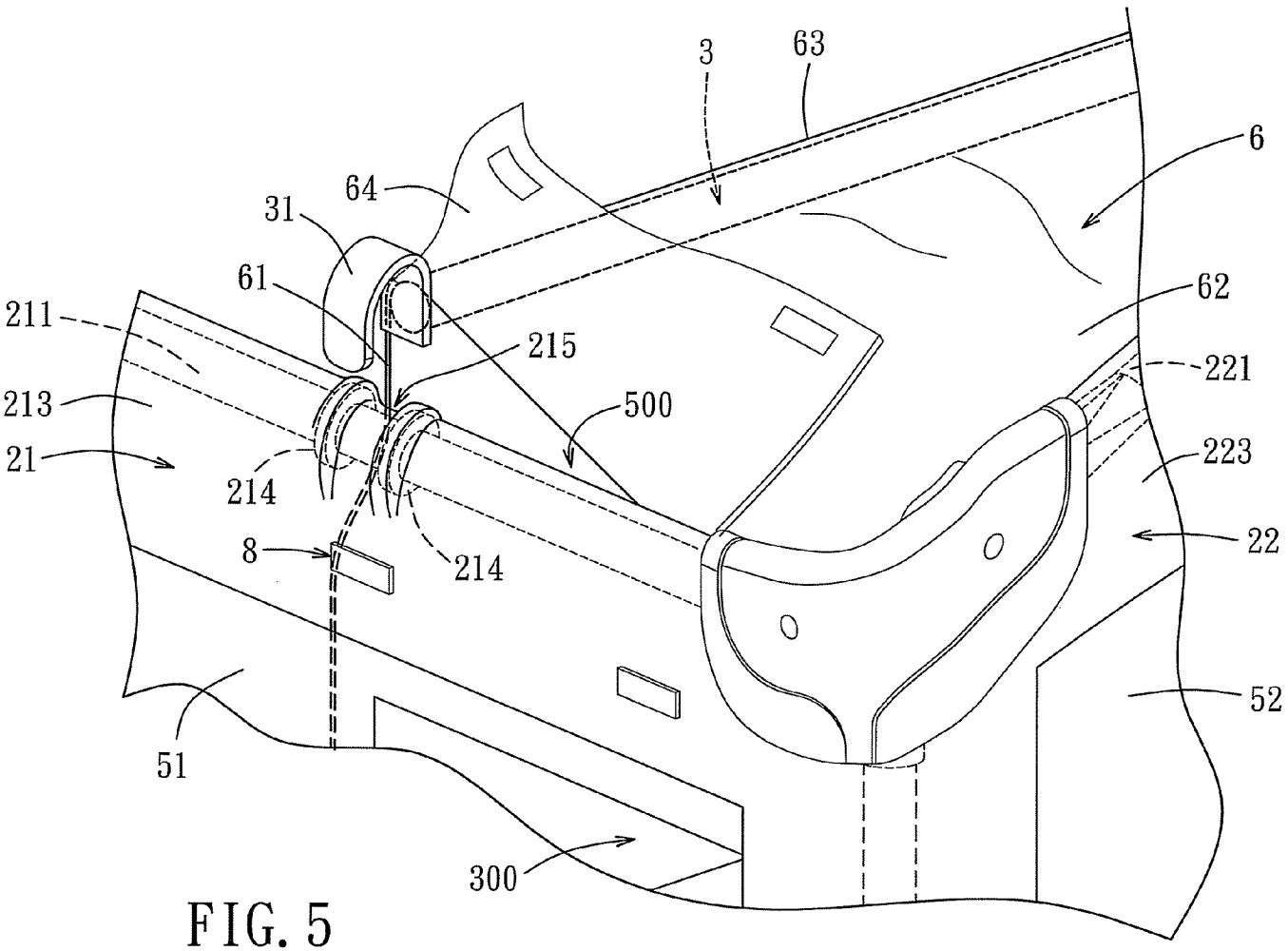
Figure 6:
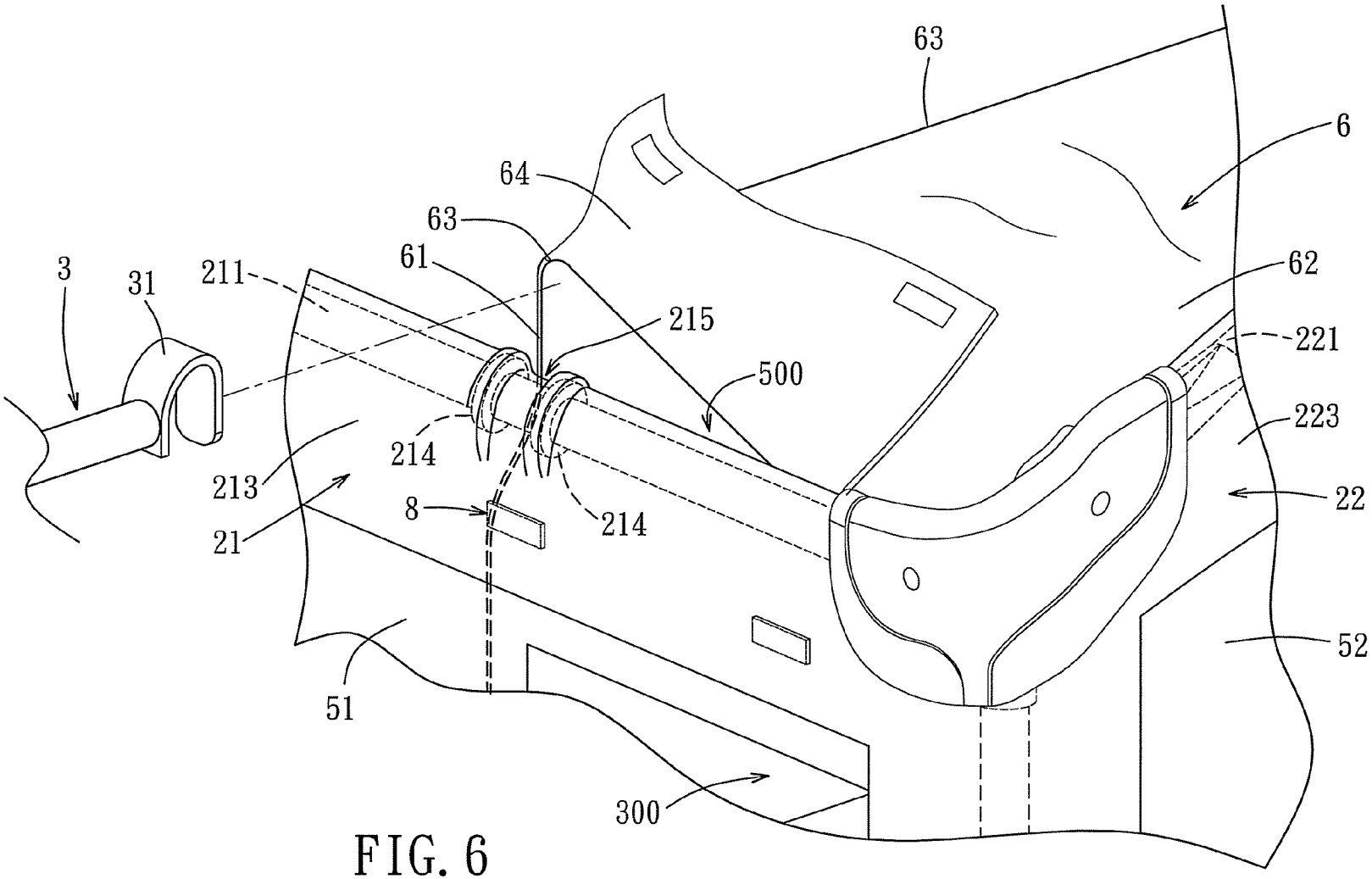

Referring to FIGS. 4 to 6, to remove the crossing rod 3 from the playyard frame 2 before folding of the playyard frame 2, the wing portions 64 of the partitioning wall 6 are lifted by peeling off from the side tube enclosures 213 (see FIG. 4), followed by simultaneously detaching the C-shaped clamps 31 from the upper side rails 21 (see FIG. 5) and lifting the crossing rod 3, and subsequently withdrawing the crossing rod 3 out of the inverted L-shaped turn 63 of the partitioning wall 6 (see FIG. 6).

The playyard frame 2 can be provided with a clamping means (not shown) so that when the crossing rod 3 is withdrawn from the inverted L-shaped turn 63 of the partitioning wall 6 and when the playyard frame 2 is folded, the crossing rod 3 can be attached to the folded playyard frame 2 through the clamping means.

Figure 7:
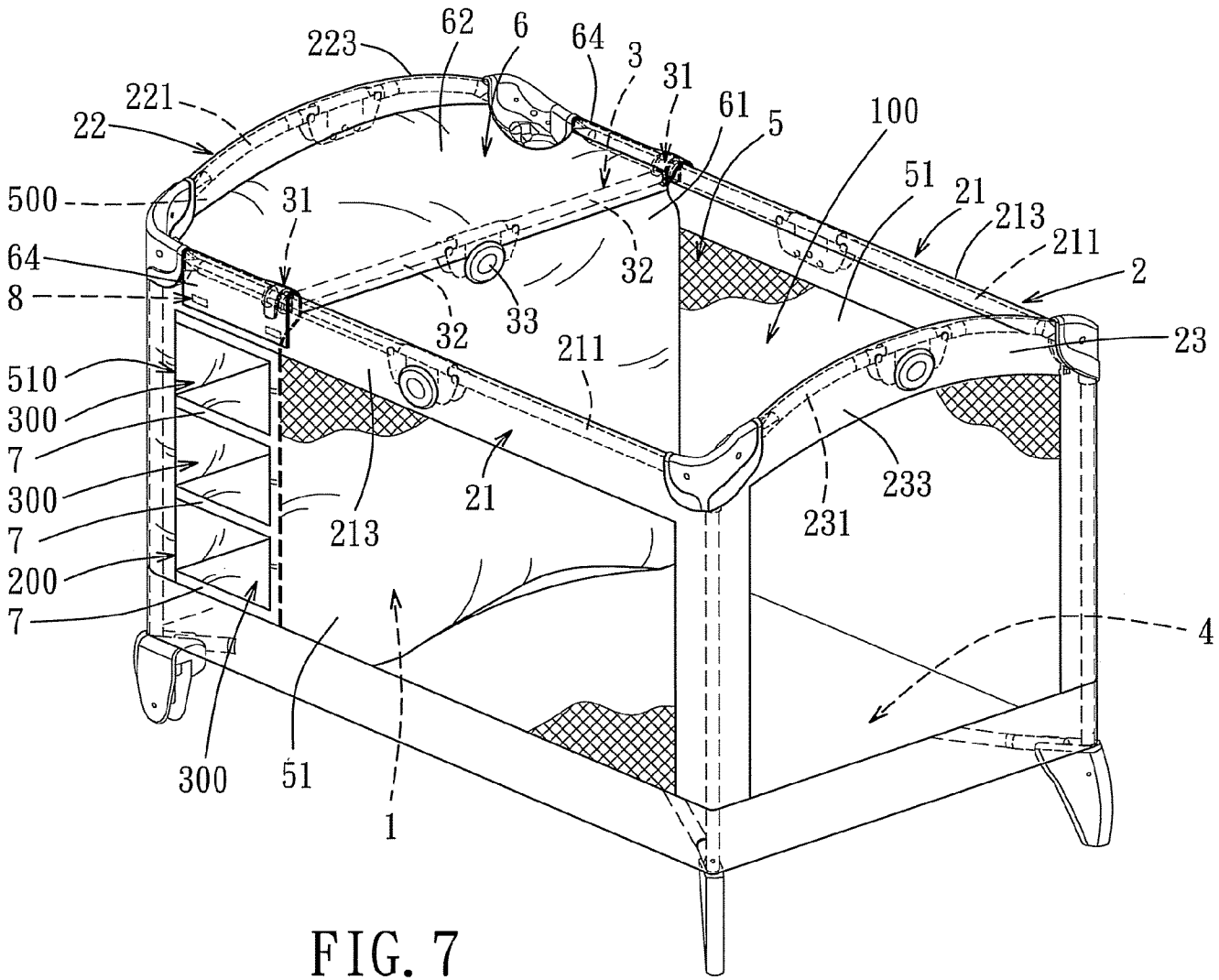
FIG. 7 is a perspective view of the second preferred embodiment of a portable playyard according to the invention.

FIG. 7 illustrates the second preferred embodiment of a portable playyard with an integrated storage unit 1 according to this invention. The second preferred embodiment differs from the previous embodiment in the structure of the crossing rod 3. In this embodiment, the crossing rod 3 is foldable and has two rod halves 32 connected to each other in an end-to-end manner through a connection joint 33 pivoted to the rod halves 32, and two end connectors of C-shaped clamps 31 mounted securely to the upper side rails 21 and pivoted to the rod halves 32, respectively. As such, unlike the previous embodiment, the crossing rod 3 can remain on the playyard frame 2 during folding of the playyard frame 2, thereby facilitating assembly and disassembly of the playyard as well as storage of the playyard.

Since the partitioning wall 6, the shelves 7 and/or the crossing rod 3 are integrated with the playyard frame 2 of the playyard of this invention, the aforesaid left behind drawback during traveling and undesired formation of the protruding obstacle as encountered in the prior art can be eliminated. In addition, since the partitioning wall 6 is stitched to the side walls 51 and the shelves 7 are stitched to the partitioning wall 6 and the side walls 51 and the end wall 52 of the surrounding wall unit 5, the storage unit 1 together with the surrounding wall unit 5 is collapsible and can support a load heavier than the hooks of the aforesaid conventional playyard and maintain intact of the extended state under the load. Moreover, since the storage unit 1 is disposed within the inner space 100 in the surrounding wall unit 5, the aforesaid undesired formation of the protruding obstacle as encountered in the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A portable playyard, comprising:

a foldable playyard frame having two opposite upper side rails and an upper end rail interconnecting said upper side rails in end-to-end relationship;

a crossing rod bridging said upper side rails and disposed adjacent to said upper end rail;

a flexible loop-shaped surrounding wall unit mounted to said playyard frame and defining an inner space, said surrounding wall unit including two opposite side walls connected respectively to said upper side rails and extending downwardly therefrom, and an end wall connected to said upper end rail and extending downwardly therefrom;

a flexible partitioning wall connected to said playyard frame, trained on said crossing rod, and having a vertical wall portion extending downwardly from said crossing rod into said inner space, said vertical wall portion being secured to said side walls and cooperating with said end wall to define a chamber therebetween, wherein said flexible partitioning wall is collapsed when said playyard is folded such that said chamber is not defined when said playyard is folded; and at least one flexible shelf disposed in said chamber, interconnecting said vertical wall portion and said end wall, and cooperating with said vertical wall portion to form a storage compartment therebetween for storing articles therein.

2. The portable playyard as claimed in claim 1, wherein said upper side rails cooperates with said upper end rail and said crossing rod to define an upper opening thereamong, said partitioning wall further having an extension wall portion extending from said vertical wall portion, said extension wall portion being secured to said upper end rail and covering said upper opening.

3. The portable playyard as claimed in claim 2, wherein said extension wall portion cooperates with the vertical wall portion to form a generally inverted L-shaped turn therebetween, said inverted L-shaped turn being trained on said crossing rod.

4. The portable playyard as claimed in claim 1, wherein said crossing rod is detachably mounted to said upper side rails.

5. The portable playyard as claimed in claim 4, wherein said crossing rod has two opposite ends, each of which is provided with a C-shaped clamp that is sleeved on a respective one of said upper side rails.

6. The portable playyard as claimed in claim 1, wherein said surrounding wall unit, said partitioning wall and said shelf are made from a fabric material.

7. The portable playyard as claimed in claim 1, wherein at least one of said side walls and said end wall is formed with an access opening for access into said storage compartment.

8. The portable playyard as claimed in claim 1, wherein said crossing rod has a connection joint, two rod halves pivoted to said connection joint, and two end connectors pivoted to said rod halves and mounted to said upper side rails, respectively.

* * * * *